US007674177B2

(12) United States Patent
Cole

(10) Patent No.: US 7,674,177 B2
(45) Date of Patent: Mar. 9, 2010

(54) GAMING MACHINE METERING AND ACCOUNTING SYSTEM

(75) Inventor: Joseph W. Cole, Las Vegas, NV (US)

(73) Assignee: Cole Kepro International, LLC, Las Vegas, NV (US)

( * ) Notice: Subject to any disclaimer, the term of this patent is extended or adjusted under 35 U.S.C. 154(b) by 1020 days.

(21) Appl. No.: 11/389,276

(22) Filed: Mar. 24, 2006

(65) Prior Publication Data

US 2006/0178208 A1 Aug. 10, 2006

Related U.S. Application Data

(63) Continuation-in-part of application No. 10/852,807, filed on May 25, 2004, now Pat. No. 7,025,676, which is a continuation of application No. 09/872,132, filed on Jun. 1, 2001, now Pat. No. 6,743,095.

(51) Int. Cl.
*A63F 9/24* (2006.01)

(52) U.S. Cl. ..... 463/25

(58) Field of Classification Search ..... 463/25, 463/30–31, 39, 43, 47
See application file for complete search history.

(56) References Cited

U.S. PATENT DOCUMENTS

| | | | | |
|---|---|---|---|---|
| 4,004,097 | A | 1/1977 | Spaulding | |
| 4,352,104 | A | 9/1982 | Mizuta et al. | |
| 5,257,179 | A | 10/1993 | DeMar | |
| 5,470,079 | A | 11/1995 | LeStrange et al. | |
| 5,477,952 | A | 12/1995 | Castellano et al. | |
| 5,580,310 | A | 12/1996 | Orus et al. | |
| 6,048,269 | A | 4/2000 | Burns et al. | |
| 6,729,957 | B2 | 5/2004 | Burns et al. | |
| 6,729,958 | B2 | 5/2004 | Burns et al. | |
| 6,736,725 | B2 | 5/2004 | Burns et al. | |
| 6,743,095 | B2 | 6/2004 | Cole et al. | |
| 7,014,355 | B2 | 3/2006 | Potter et al. | |
| 7,025,676 | B2 | 4/2006 | Cole et al. | |
| 2004/0229677 | A1 * | 11/2004 | Gray et al. | 463/17 |
| 2006/0122910 | A1 * | 6/2006 | Chau et al. | 705/26 |
| 2006/0160621 | A1 | 7/2006 | Rowe et al. | |

* cited by examiner

*Primary Examiner*—Kim T Nguyen
(74) *Attorney, Agent, or Firm*—Weide & Miller, Ltd.

(57) ABSTRACT

The present invention is an intelligent metering system for currency-activated devices having an electromechanical meter. The intelligent metering system includes an inductive pickup winding associated with the electromechanical meter. An amplifier is coupled to the inductive pickup winding to boost a signal detected from the inductive pickup winding when electromechanical meter is actuated. A pulse detector, coupled to the amplifier, detects pulses, false triggerings and filters out EMF spikes. A microprocessor is coupled to the pulse detector for counting the pulses detected by the pulse detector and for storing meter data related to the counted pulses in a memory device. An interface is coupled to the microprocessor for transmitting the meter data from the memory device.

8 Claims, 8 Drawing Sheets

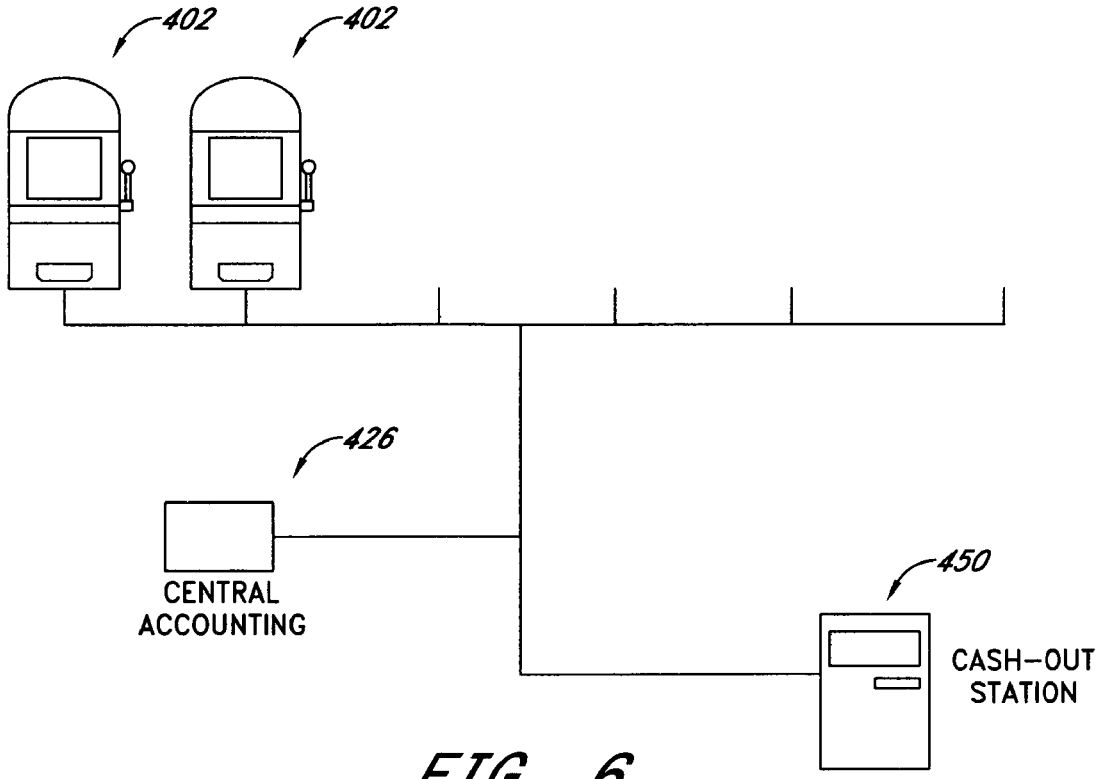
FIG. 6
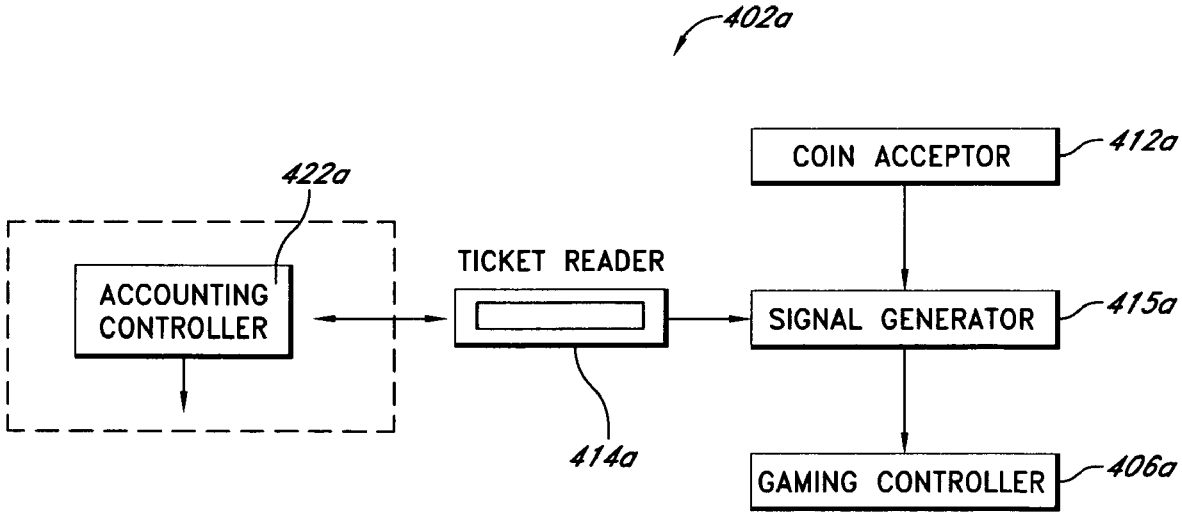
FIG. 7 (NON-PULSE VERSION)

GAMING MACHINE METERING AND ACCOUNTING SYSTEM

RELATED APPLICATION DATA

This application is a continuation-in-part of U.S. application Ser. No. 10/852,807, filed May 25, 2004, now U.S. Pat. No. 7,025,676 which is a continuation of U.S. application Ser. No. 09/872,132, filed Jun. 1, 2001, now U.S. Pat. No. 6,743,095.

FIELD OF THE INVENTION

The present invention is directed to a metering and accounting system having particular utility with one or more gaming machines.

BACKGROUND OF THE INVENTION

The gaming, arcade, and vending machine industry relies heavily on electromechanical counters, otherwise referred to as meters, to count coin and currency input. These electromechanical counters are the default standard used by gaming compliance agencies and other business entities to keep track of the monetary history of these devices. The meters report coin-in, coin-out (coins paid out), coins to drop (coins that go to the drop bucket), the number of games played, the number of jackpots, etc. Vending machines and arcade game machines use meters for similar functions.

FIG. 1 illustrates an example of such a meter as used in a gaming machine for tracking "coins in". As illustrated, the meter 20 is associated with a meter interface 22. The interface 22 is normally associated with a master gaming machine controller 24. The meter 20 includes a visible count indicator 26 in the form of rotating wheels having numbers printed thereon, the wheels cooperating to present a value indicative of coin input or other data. A person may visually inspect the count indicator 26 to obtain the data.

In use, a signal may be transmitted from a coin comparator 30 or hopper 32 indicating that a coin has been received. This signal may be transmitted to the master gaming machine controller 24. The master gaming machine controller 24 then sends a signal to the meter interface 22 indicating that a coin has been input, and that the meter 20 should be caused to increment the visible count indicator 26. The signal from the master gaming machine controller 24 to the meter interface 22 is generally in accordance with a unique, and often proprietary communication/data protocol. The importance of this will be understood below. In any event, once the interface receives the data, it sends a signal to the meter 20 causing the meter to mechanically rotate one of the wheels of the count indicator 26 to reflect the coin input.

In the gaming industry, electronic systems have been devised that tap into the wire leads of the electromechanical meters and use an optically-isolated circuit that receives current when the meter is energized. This is used to acquire what is commonly known as the "soft" count (as opposed to a "hard" count, which comprises viewing the visible count indicator to obtain the data), because the machine system software is used to store the updated meter information in the machine logic board, or in a computer database via a network from the machine.

The interface and installation of these systems are labor intensive and require skilled technicians to properly tap into the meters. Errors in the installation can cause the machine and the meter to malfunction. For example, by tapping into the meter leads, the impedance and other electrical characteristics of the circuit may be substantially altered. This alteration may prevent proper operation of the meter. Additionally, the amount of circuitry and cabling required to interface with all of the various types of machines and manufacturers is extensive.

Another problem is that the firmware program required to support all of the different installations and machine types is extensive and requires very specialized programming skills. In the gaming industry, the more modern slot machine designs provide meter information via a specialized serial interface which, as discussed above, may operate in accordance with a proprietary protocol. Because slot machine vendors often sell electronic slot machine accounting systems, they will charge fees to use the protocol. Some of these protocols have become industry standards, and the owners of these standards charge fees for the latest versions or enhancements. Thus, obtaining the meter information by tapping into the data lines first requires knowledge of ever-changing protocols and complex programming, and may also require payment to the slot machine vendor which owns the rights in the proprietary protocol.

No matter how new the design of the machine is and the protocol for data transfer with its interface, however, the electromechanical meter is still the standard for measurement. Just like an odometer in an automobile, it must be reliable and trusted and not easily tampered with. The electromechanical meter manufacturers design these devices to work reliably for millions of cycles. The meters are placed in machines to function autonomously. They are mounted in the machine housing, and even if the logic board of a machine is changed (such as putting a new game into an old machine, using new hardware and/or software), the meters remain intact. In a gaming environment, a meter change in a slot machine, or any other gaming machine, must be reported to the appropriate gaming compliance agency.

Nevertheless, electromechanical counters are sill prone to tampering. Although these electromechanical counters do not have a reset feature, they still may be physically altered. Furthermore, a person reading the electromechanical counter may mistakenly misread and record the number shown on the meter, or an unscrupulous individual may deliberately record the wrong number. Therefore, inaccurate data of the financial performance of the machines would be reported. The ability to tamper with the counters to meters without detection has lead to abuse by unscrupulous collectors and service personnel who may decrease the number of games played (or coins inserted, etc.) in order to collect the unreported portion of the revenue.

Additional issues with "wager" type gaming is tracking payments made to gaming machines (often referred to as "coin-in") and payouts made by gaming machines (often referred to as "coin-out"), and providing convenient methods for paying winning players and permitting players to move credits or value from one machine to another. As indicated, payments made to and made by gaming machines are currently confirmed using mechanical meters. This method is cumbersome and does not permit instantaneous and remote verification of gaming machine accounting data. Separate systems are used to pay players, such as complex voucher systems which include central hosts which generate ticket information when a player wishes to cash-out and which are used to verify and pay tickets when the player wishes to redeem their ticket or provide value to a gaming machine.

SUMMARY OF THE INVENTION

The present invention comprises a secondary metering system for a gaming machine, an accounting system for a plurality of gaming machines, a plurality of gaming machines including accounting units, and a plurality of gaming machines configured to generate and issue, as well as accept, tickets representing value.

One embodiment of the invention is a secondary metering system. The secondary metering system is design to be associated with a primary metering system of a gaming machine, the primary metering system including one or more electromechanical meters having count indicators.

In one embodiment, the secondary metering system includes a detector for passively detecting an event of the electromechanical meter. In a preferred embodiment, such an event comprises the receipt of an electrical signal activating the electromechanical meter for incrementing or decrementing a visible count indicator of the meter. The detector provides an output to a controller. The controller manipulates the detector output, such as by counting output signal pulses and/or transmitting an output.

In one embodiment, the detector comprises an inductive pickup coil or winding. The controller includes an amplifier coupled to the inductive pickup winding to boost a signal detected from the inductive pickup winding, a pulse detector coupled to the amplifier for detecting pulses, a microprocessor coupled to the pulse detector for counting the pulses detected by the pulse detector and for storing meter data related to the counted pulses in a memory device, and an interface coupled to the microprocessor for transmitting the meter data from the memory device.

In one embodiment, the inductive pickup coil comprises a secondary winding on an actuator electromagnet of the electromechanical meter. In another embodiment, the inductive pickup coil is located in a housing positioned adjacent the electromechanical meter.

One embodiment of the invention is a gaming machine including accounting capabilities. In one embodiment a gaming machine includes an accounting unit comprising an accounting controller and associated memory. Preferably, the accounting unit is configured to receive signals from a secondary metering system associated with one or more meters of a primary metering system of the gaming machine, the meters registering monetary events at the gaming machine. Collected meter information regarding monetary events at the gaming machine, such as value-in (such as coin or credit-in), wins, wagers and the like, are utilized by the accounting unit to create accounting data for the machine.

One or more gaming machines including accounting capabilities are associated with one or more accounting servers or hosts. The accounting controller of each gaming machine is configured to transmit accounting information to the host, which may be remotely located. In this manner, accounting data may be tracked in real time, remotely from the gaming machine. The accounting information may be used to audit the gaming machine, including monies collected at the machine and paid at the machine to ensure proper operation of the machine and to detect possible fraud. The accounting host may be associated with one or more output devices such as displays or printers to output accounting information to a user of the system, such as displayed accounting data.

Another embodiment of the invention is a gaming machine configured to generate and dispense value tickets and accept those tickets, and a system including a plurality gaming machines so configured.

In one embodiment, a gaming machine includes an accounting system associated with a secondary metering system, the accounting system configured to generate accounting information, such as the number of credits or monetary value belonging to a player and associated with the gaming machine. Upon receiving a signal that a player wishes to "cash-out," such as from a gaming controller of the machine in response to a player input, the accounting system is configured to generate ticket information. In one embodiment, this information includes a ticket identifier. The ticket identifier may include a gaming machine number and a ticket number. Preferably, the gaming machine number or identifier is unique to the gaming machine as to all gaming machines associated with the system, and the ticket number is unique to the particular machine. In this manner, each ticket identifier for all tickets generated by all machines of the system are unique. The information also includes the value of the ticket and may include additional information, such as the time the ticket was generated. Ticket information including the ticket identifier and ticket value are stored in a memory which is preferably associated with the accounting controller.

Ticket information is transmitted from the accounting controller to a ticket printer of the gaming machine. The ticket printer then prints and dispenses the ticket to the player.

The gaming machines include a ticket reader. In response to the input of a ticket, ticket information is read and transmitted to the accounting controller of the machine. The accounting controller then determines if it generated the ticket. If so, the accounting controller verifies the ticket, such as by determining if the ticket has already been redeemed. If the ticket is verified, then ticket value information is forwarded to the reader.

If the ticket is not identified by the accounting controller at which the ticket is presented, the accounting controller sends the ticket information out for verification by the machine at which the ticket was generated. The controller may send a global signal or a particular signal based upon the machine code. The accounting controller of the machine at which the ticket was generated verifies the ticket in response to the signal, obtains the ticket value from its memory, and transmits the value to the gaming machine at which the ticket was presented.

Once the ticket value is provided to the reader, the reader outputs a signal to cause the gaming controller to register credits in the value of the ticket. In one embodiment, the reader sends a signal to pulse generator which causes the pulse generator to generate pulses equalling the number of credits having the ticket value. Those pulses are registered by the gaming controller, thus enabling the player to utilize the credits for game play.

Further objects, features, and advantages of the present invention over the prior art will become apparent from the detailed description of the drawings which follows, when considered with the attached figures.

DESCRIPTION OF THE DRAWINGS

FIG. 6 is a schematic diagram of an accounting system of the invention;

FIG. 7 is a block diagram of a gaming machine including an accounting unit and configured to generate and accept tickets in accordance with another embodiment of the invention;

DETAILED DESCRIPTION OF THE INVENTION

The invention comprises a metering system, an accounting system, and a method and apparatus for coin or cash-less gaming. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a metering system. The metering system has particular applicability to a gaming machine having a primary metering system including mechanical counters. Another embodiment of the invention is an accounting system for one or more gaming machines. The accounting system permits tracking of gaming machine monetary activities, including value-in and value-out at the gaming machine. The accounting system preferably includes the metering system of the invention. Yet another embodiment of the invention is a method and apparatus permitting coin or cash-less gaming. In accordance with this embodiment of the invention, gaming machines are configured to issue value tickets or slips to players, such as at cash-out, in lieu of coins or cash. Gaming machines are configured to accept value tickets or slips, such as in lieu of coins or cash, for placing monetary wagers to play games.

Figure 1:
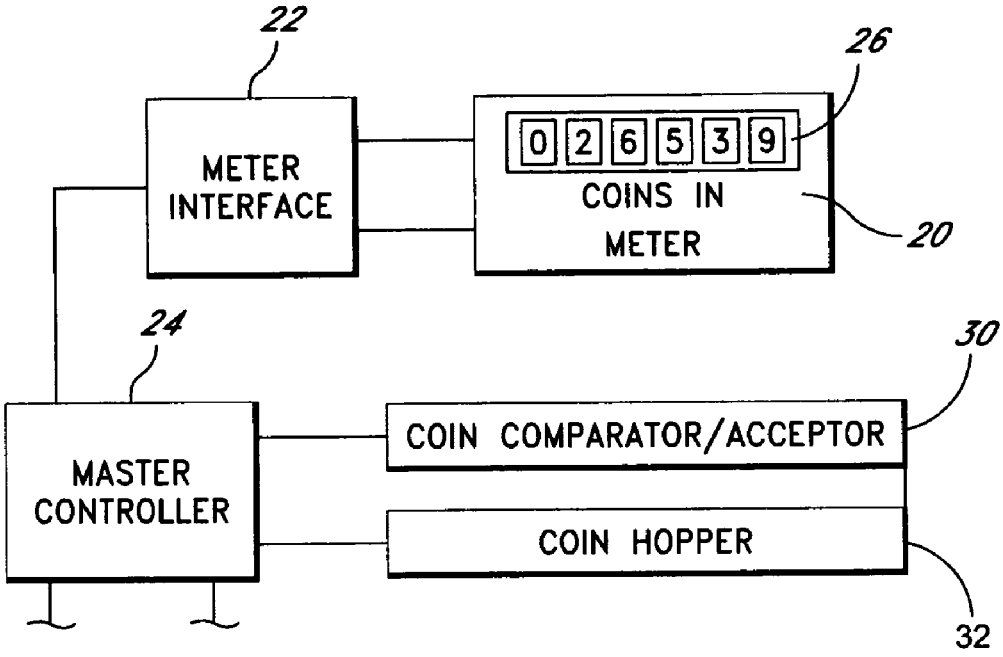
FIG. 1 (PRIOR ART)
FIG. 1 illustrates an electromechanical meter and associated control in accordance with the prior art.
Figure 2:
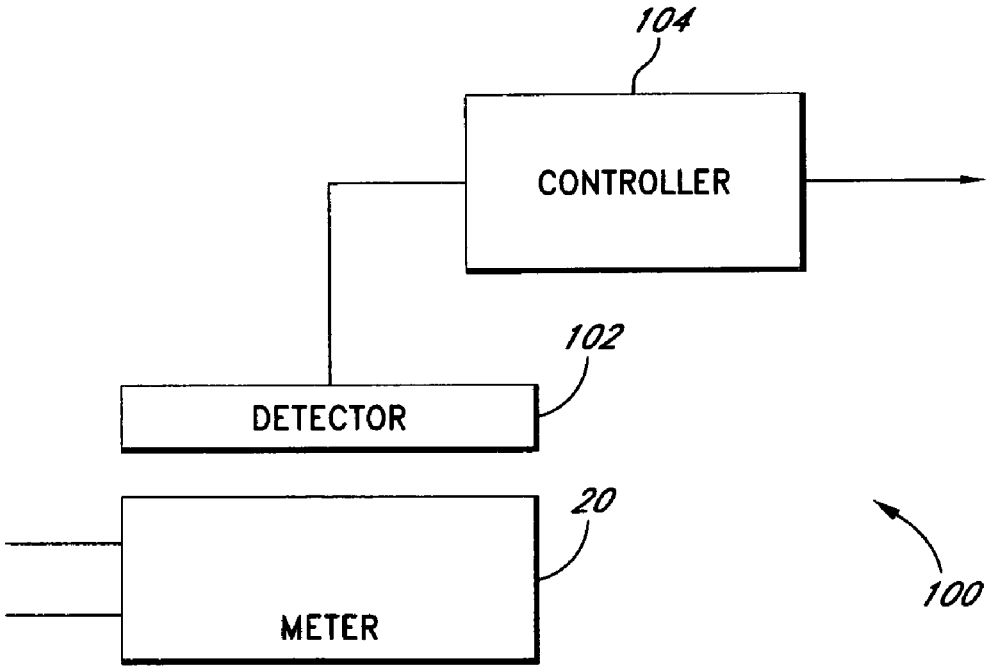
FIG. 2 is a schematic diagram of the intelligent metering system in accordance with the present invention.

FIG. 2 is a schematic diagram illustrating an intelligent metering system 100 in accordance with an embodiment of the present invention. As illustrated, the intelligent metering system 100 comprises a secondary metering system associated with a primary metering system. Preferably, the primary metering system comprises a metering system such as that illustrated in detail in FIG. 1, including an electromechanical meter 20. As detailed above, such a primary metering system may include a meter interface for generating an electrical signal which activates the electromechanical meter, causing the meter to actuate. In one embodiment, the actuation is of a visible indicator of the meter.

In accordance with the invention, the intelligent metering system includes a detector 102 and a controller 104. In general, the detector 102 is arranged to detect a meter event. In one embodiment, the detector 102 is arranged to detect a signal associated with the incrementing/decrementing of the meter 20, and more particularly the visible count indicator thereof. In the preferred embodiment of the invention, the detector 102 comprises a "passive" detector, in that it is arranged to detect such an event/signal without needing to directly intercept the signal. In one embodiment, the detector 102 comprises a field sensor (such as described below in detail).

In another embodiment, the detector 102 may be arranged to detect a meter event by other than detection of the signal. For example, the detector 102 may comprise an optical sensor for detecting the movement of one or more of the wheels or other moving mechanical indicators of the meter 20. In another embodiment, the detector 102 may comprise a reader; such as a camera or other optical reader for reading the visible count indicator itself.

The detector 102 is arranged to provide an output signal to the controller 104. The controller 104 may comprise a wide variety of devices/components. Preferably, the controller 104 comprises a device which receives the detector 102 output signal and manipulates or transfers that signal. In one embodiment, the controller 104 may use the signal as an input to change a data value in a memory, the data value associated with the signal event (such as the counting of coins input). In another embodiment, the controller 104 may output the signal or other data to a remote device or devices, such as a remote accounting system where data is tracked and stored.

Figure 3:
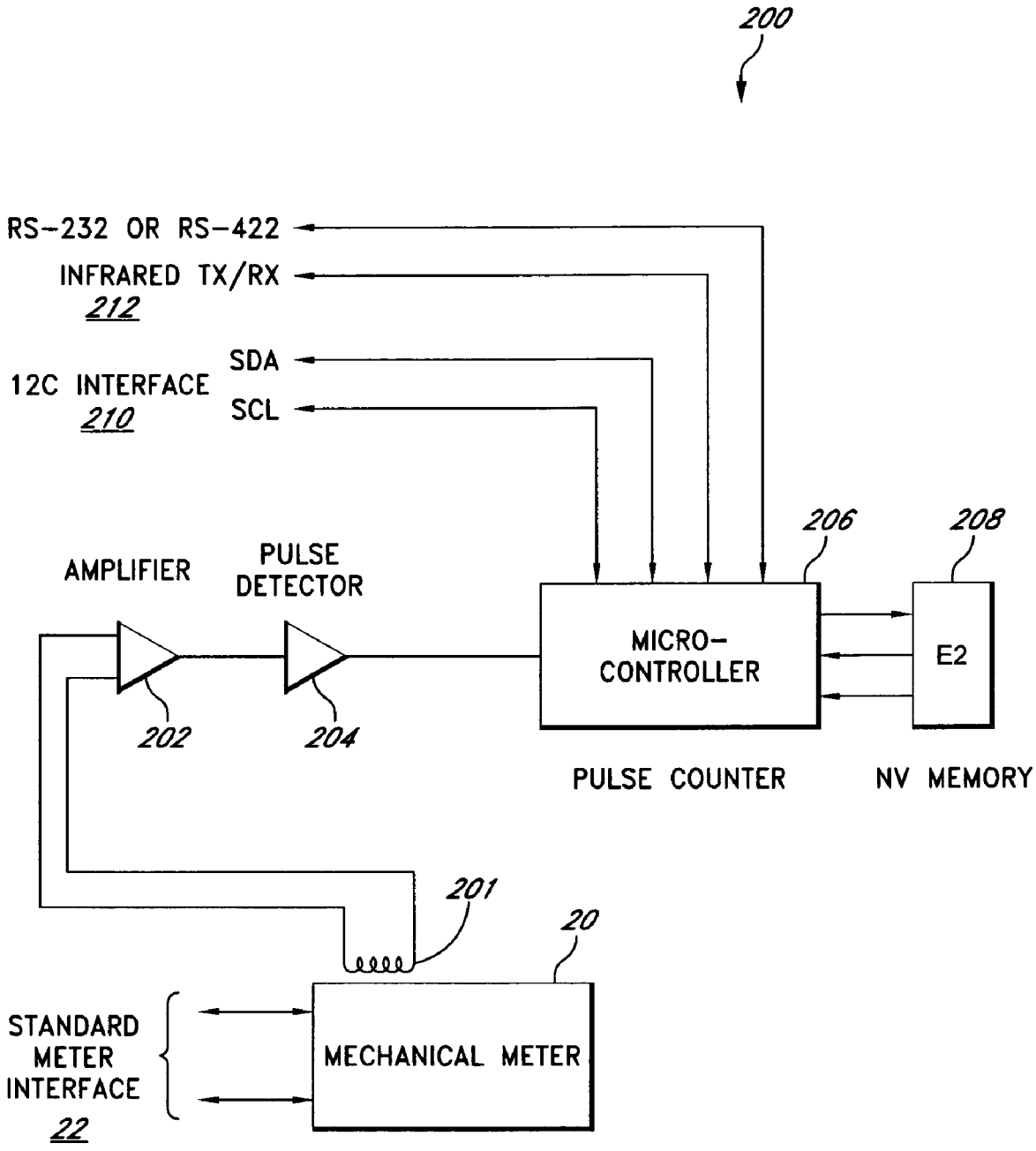
FIG. 3 is a schematic diagram of a particular implementation of an intelligent metering system according to an embodiment of the present invention.

FIG. 3 illustrates a preferred embodiment of a metering system 200 in accordance with the invention. In this embodiment, the detector comprises an inductive pickup winding or coil 201. In one embodiment, the pickup coil 201 may be located adjacent to the meter 20 for detecting a magnetic flux generated by an electrical signal/impulse. In this embodiment, the coil 201 may be positioned in a housing which is mounted adjacent to or directly to the meter 20. The construction of the coil 201, including the number of windings, may vary depending on the desired sensitivity, the distance of the coil 201 from the wires carrying the electrical signal in the meter 20, and the strength of the signal in the meter 20, among other factors. In this embodiment, it will be appreciated that the detector is a passive detector, in that only by activation of the meter 20 is the detector (i.e. coil 201) activated.

In another embodiment of the invention a standard electromechanical counter may be manufactured with a secondary winding on the actuator electromagnet of the electromechanical meter 20. This secondary winding is used as the inductive pickup winding/coil 201. The inductive pickup coil 201 is used in conjunction with the electronic circuits of the metering system to sense and count the counter actuations without affecting the normal operation or reliability of the electromechanical meter 20. In one embodiment, the inductive pickup winding 201 is preferably formed from 15-17 turns of an enamel-coated 34-gauge solid copper wire.

In this embodiment, the controller comprises an amplifier 202, a pulse detector 204 a pulse counter 206, and a memory 208. The amplifier 202 boosts a signal from the inductive pickup winding 201 when the actuator electromagnet is actuated so that the signal has enough amplitude to trigger the pulse detector 204. For example, when currency is placed into a slot machine, the slot machine determines the value of the currency deposited, and then transmits an actuation signal to the actuator electromagnet of the electromechanical meter 20 to actuate the meter 20 a specific number of times depending on the value of the currency and the value of the units to be registered by the meter 20. For example, if a dollar is inserted into the slot machine and the electromechanical meter 20 stores the units in increments of 25 cents, then the actuator electromagnet will receive four actuation signals to add four "turns" to the electromechanical meter 20. When the electrical signal is sent to the actuator electromagnet to turn the electromechanical meter 20, the inductive pickup coil 201, along with the electronic circuits of the metering system, passively detects, counts and records each of the signals made to the actuator electromagnet.

The pulse detector 204 preferably comprises a comparator circuit with hysteresis so as to illuminate false triggering and to filter out EMP spikes, along with its primary purpose of detecting pulses. In one or more embodiments of the invention, the pulse detector 204 may simply comprise a low-pass filter.

The microprocessor 206 is used to count the pulses as the electromechanical meter 20 is actuated. The microprocessor 206 may be of a variety of types. In one embodiment, the microprocessor 206 comprises an 8-bit microcontroller such as a Phillips Semiconductor Model 87C751 microprocessor.

In one embodiment, the microprocessor 206 is also adapted to store pulse/count meter data in a memory device 208. In a preferred embodiment, the memory device 208 comprises a non-volatile memory device such as an Amtel 93C46 electrically-erasable programmable read-only (EEPROM) memory chip. The memory device 208 may be of a variety of other types, including RAM, DRAM, SDRAM and the like.

In one embodiment, the intelligent metering system 200 includes means for transmitting meter data to a remote device. Preferably, this means comprises a communication interface associated with the microprocessor 206 for outputting data therefrom.

In one embodiment, first and second interfaces 210 and 212 may be coupled to the microprocessor 206 to transmit the meter data to an external device. For example, the microprocessor 206 may utilize an industry standard I2C 3-wire interface 210, or a standard EIA RS-232 or RS-422 interface 212, or both, for connecting to a networked electronic accounting system, or to an external receiving device. Optionally, a wireless transceiver interface (not shown) may also be used to download the meter data to a palm-top computer device, a laptop computer, or other similar receiving device equipped with a port capable of interfacing with the transceiver. The wireless interface may be adapted to implement an infrared or radio frequency communication architecture/protocol, such as Bluetooth™ or IEEE 802.11(b).

The intelligent metering system according to an embodiment of the present invention may be especially useful for acquiring slot machine, vending machine, or arcade machine hard count meter data (electromechanical readings) remotely via radio frequency, or via a land-based media, such as over a telephone line or a paging system.

In addition to currency-driven machines, such as slot or other gaming machines, vending machines, or arcade machines, the intelligent metering system may be utilized in any device having an electromechanical meter or counter, such as in a printing or photocopier machine. Therefore, service personnel do not need to open up the machine and read the electromechanical meter, but may only need to simply connect a portable receiving device, such as a hand-held computer, into the interface of the printing or photocopier machine to read and record the meter data.

The intelligent metering system according to an embodiment of the present invention does not require any other special interface in order to detect the actuation of the electromechanical meter. In addition, no special protocols are required, as industry standard interfaces are used to transmit data from the metering system.

Therefore, in utilizing the intelligent metering system of the present invention, an accurate "hard" count reading may be obtained, and the values may also be compared with the electromechanical meter in order to verify accuracy, as well as determining whether the electromechanical meter itself has been tampered. Furthermore, the values obtained from the intelligent metering system are as reliable as the "hard" count reading because the intelligent metering system is entirely passive and dependent upon the actuation of the actuator electromagnet of the electromechanical meter 20. That is, it "counts" a pulse only when the electromechanical meter 20 is actuated and requires no active input (such as electrical leads carrying a live current). Therefore, the intelligent metering system does not have live wires connected to it in order to receive direct signals each time the actuator electromagnet of the electromechanical meter 20 receives a signal.

The intelligent metering system is preferably self-contained and entirely separate from the logic/circuit board of the machine in which it is placed. The self-contained intelligent metering system is such that any tampering with the logic/circuit board of the machine will not affect the intelligent metering system. And, to be as tamper resistant as possible, the intelligent metering system should not be dependent upon external power sources; that is, the microprocessor 206 and the memory 208 should be self-powered and maintenance free. The intelligent metering system should be functional in the event of a power failure, or even when no power at all is provided to the machine it which it is placed. Furthermore, the memory 208 should be unable to receive inputs from any other source except from the microprocessor 206 of the intelligent metering system. In addition, the intelligent metering system should be secure enough so that tampering of any of its components, especially the microprocessor 206 and the memory 208, is not possible, or that the intelligent metering system is capable of recognizing when tampering has occurred and recording such information. Therefore, the intelligent metering system, working in conjunction with the electromechanical meter 20, is capable of providing accurate and reliable "hard" count meter data, and accurate transmission of the meter data may be performed via the interface. The intelligent metering system also provides a reliable and accurate system for storing meter data that is more tamper resistant than electromechanical meters or counters.

An advantage of the intelligent metering system of the invention is that it can be associated with an existing primary metering system already in use in a device. Thus, the intelligent metering system can easily be adapted in "retrofit" fashion to an existing device. In one embodiment, the retrofit comprises the installation of the detector (such as winding 201) near the meter 20, along with the controller. In an embodiment where the detector comprises a secondary winding on the actuator electromagnet of the electromechanical meter 20, then the actuator electromagnet of the meter 20 or the entire meter 20 may be replaced.

Figure 4:
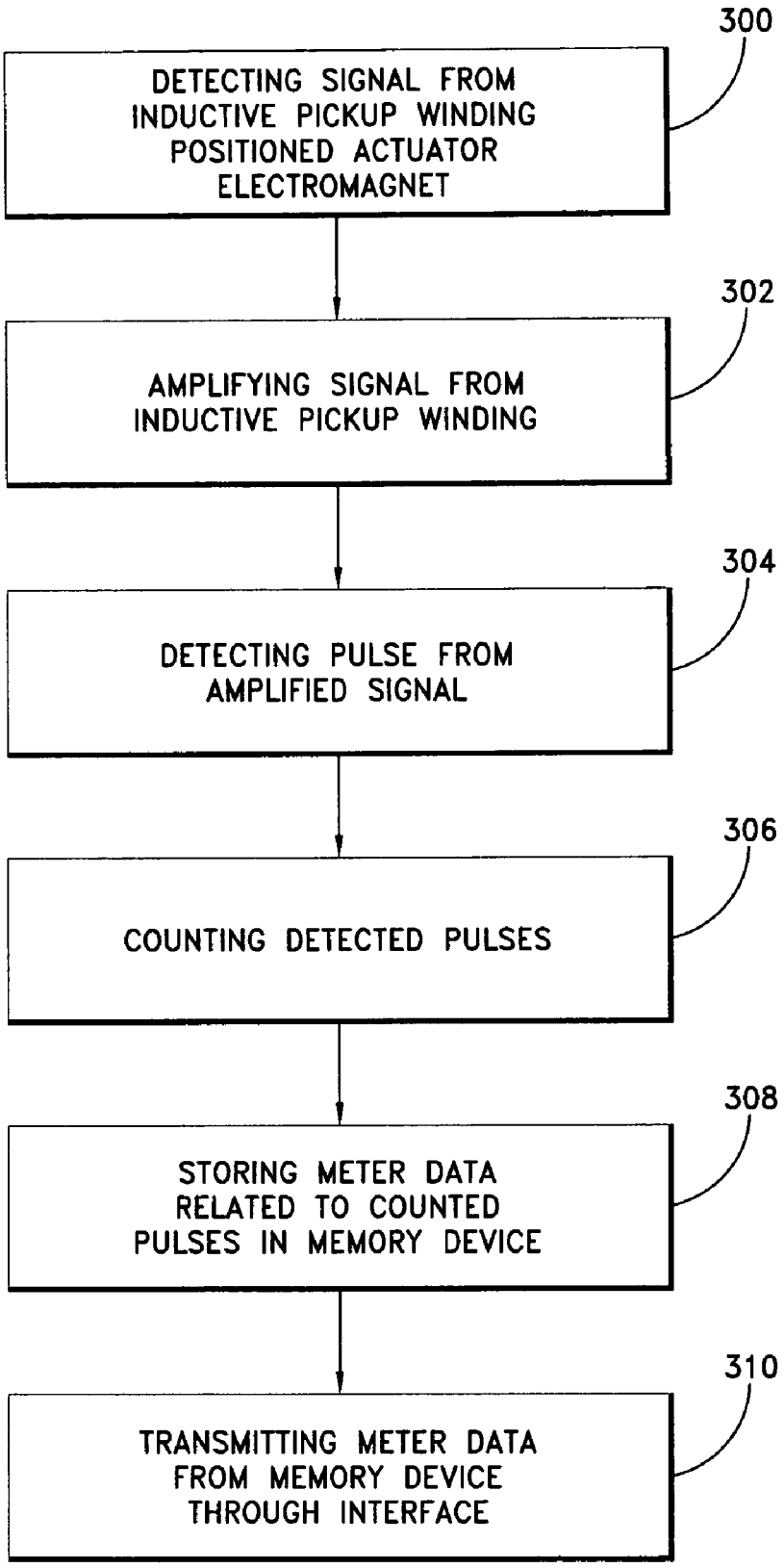
FIG. 4 is a block diagram of the steps of a method of reading an electromechanical meter according to an embodiment of the present invention.

FIG. 4 illustrates a block diagram of the steps of reading an electromechanical meter according to an embodiment of the present invention. Using the intelligent metering system according to an embodiment of the present invention described above, step 300 shows that a signal is first detected from the inductive pickup winding 201 positioned on the actuator electromagnet of the electromechanical meter 20 when the actuator electromagnet is actuated. In step 302, the detected signal from the inductive pickup winding 201 is amplified. Then in step 304, a pulse is detected from each amplified signal. The pulse is preferably detected by the pulse detector 204 that comprises a comparator circuit having hysteresis for detecting the pulses, detecting false triggerings, and filtering EMP spikes. In step 306, each of the detected pulses are counted, preferably by the microprocessor device 206. The microprocessor 206 preferably has a ROM or firmware storing microcode instructions for execution by the microprocessor 206 to count the detected pulses and store them as meter data. Meter data related to the counted pulses are then preferably stored by the microprocessor 206 in the memory device 208, such as a nonvolatile memory device, as in step 308. In step 310, the meter data may be transmitted from the memory device 208 through the interface 210 and 212. The interface 210 and 212 may be any standard type of interface, such as an I2C interface, or an RS-232 or RS-422 interface. As mentioned above, the meter data may be transmitted to any receiving device, such as a hand-held or laptop computer, adapted to interface with the intelligent metering system to receive the meter data.

The intelligent metering system may be adapted for use with a variety of primary metering systems. As detailed, the intelligent metering system is used with a primary metering system including an electromechanical meter for generating "coin in" count data. The system of the invention may be used with primary metering systems having electromechanical meters for generating a wide variety of other count data, such as coins out and the like.

In one or more embodiments, more than one intelligent metering system may be provided when a gaming machine includes more than one electromechanical meter. In one embodiment, the intelligent metering system may include a single controller 104 and a plurality of detectors 102, the detectors 102 associated with a plurality of electromechanical meters. In such event, the single controller 104 may be adapted to use the output signals from the plurality of detectors 102 to generate a plurality of count data.

In one or more embodiments of the invention, the intelligent metering system may be used with electronic meters. Such meters may be provided an input signal which causes an electronic display of count data to be incremented. In this arrangement, the mechanical indicator (wheels, etc.) are replaced with an LCD, LED or other electrically powered or operated display.

Another embodiment of the invention is an accounting system for one or more gaming machines. In one embodiment, the accounting system includes or incorporates the intelligent metering system described above.

Figure 5:
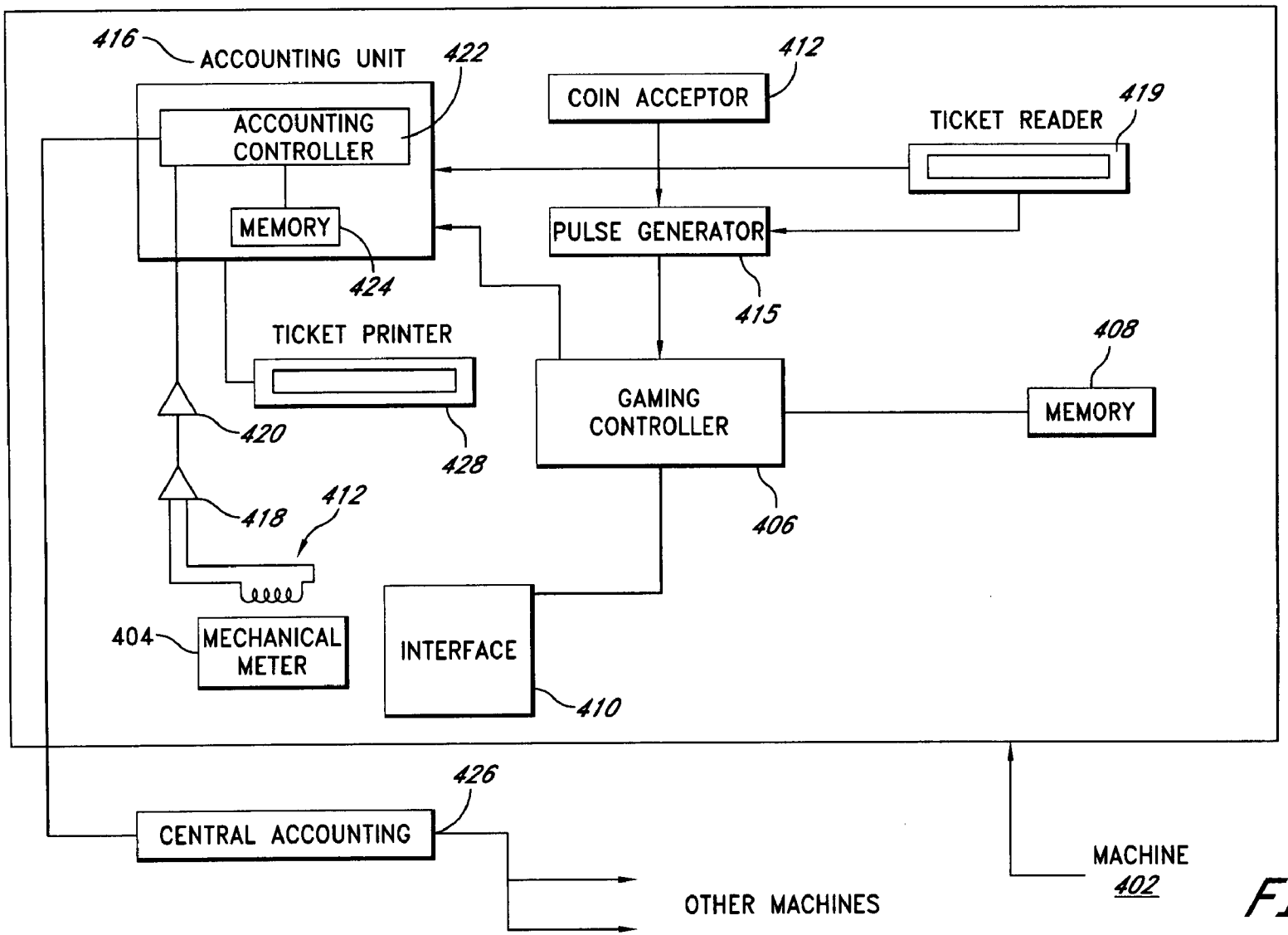
FIG. 5 is a block diagram of a gaming machine including an accounting unit and configured to generate and accept tickets in accordance with one embodiment of the invention.

One embodiment of an accounting system 400 will be described with reference to FIGS. 5 and 6. FIG. 5 illustrates a gaming machine 402. Preferably, the gaming machine 402 includes one or more mechanical meters 404 in accordance with the prior art. The mechanical meters 404 include count indicators providing information regarding monetary transaction at the gaming machine 402. For example, one or more meters 404 may be utilized to track the value of monies, whether in the form of coins, cash, credit or the like, provided by a player to the gaming machine 402 for use in playing games. One or more other meters 404 may be utilized to track the value of monies paid by the gaming machine, such as coins dispensed, winnings award or the like. Preferably, individual meters are provided for the variety of monetary events which may take place at the machine so that each and every monetary event associated with operation of the gaming machine is recorded.

As indicated above, in one embodiment of such a gaming machine, the gaming machine includes a gaming controller 406 having an associated memory 408. The gaming controller 406 provides instructions to the one or more meters 404 via one or more interfaces 410. The gaming machine 402 may include a number of devices or components relating to the acceptance and dispensing or award of monetary value. For example, the gaming machine 402 may include a coin acceptor 412 for accepting coins, and a reader 414 for accepting cash. The gaming machine 402 may include a variety of other devices, such as a coin hopper (not shown) for dispensing coins.

Preferably, the accounting system 400 includes a secondary metering system in accordance with the invention. Thus, in the preferred embodiment, the accounting system 400 includes a detector 412 corresponding to each mechanical meter 404. In one embodiment, the detector 412 comprises a coil.

The output of each detector 412 is preferably provided to an accounting unit 416. As described above, the output of the detector 412 may be amplified by an amplifier 418 and filtered with a filter 420 before being provided to the accounting unit 416.

In one embodiment, the accounting unit 416 is located at the gaming machine 402. For example, the accounting unit 416 may be located within the interior of the gaming machine 402, preferably in a secure location. In another embodiment, the accounting unit may be an "add-on" type unit which is coupled to the gaming machine or located proximate the gaming machine. In one embodiment the accounting unit 416 comprises a controller 422 and a memory 424. The controller 422 preferably includes or comprises a processor for executing instructions or performing tasks. The controller 422 may comprise hardware and/or software. The memory 424 preferably comprises a data storage device. The accounting unit 416 may include additional elements. For example, the controller 422 and memory 424 may be associated with a circuit board and be connected by a bus.

The output of the one or more detectors 412 is preferably provided to the accounting controller 422. The controller 422 may be configured to store meter data in the memory 424. For example, the accounting controller 422 may store pulse data, as described above.

Preferably, the accounting system 400 also includes an accounting host 426. The accounting host 426 preferably comprises computing device which is located remote from the gaming machine 402. For example, the gaming machine 402 may be located on a casino floor, while the accounting host 426 may be located in a secure back room.

Preferably, a communication link is provided between the accounting unit 416 and the accounting host 426. This communication link may be wired or wireless. The accounting unit 416 and accounting host 426 preferably include or are associated with a communication interface permitting the transmission and receipt of information. The particular communication protocol which is utilized to transmit and receive information or data may vary. For example, the communication protocol may be IEEE-1394, USB, 802.xx, Ethernet or the like.

Accounting data is transmitted from the gaming machine 402 to the accounting host 426 at one or more times. In one embodiment, accounting data in the form of collected meter data is transmitted from the accounting unit 416 to the accounting host 426. In another embodiment, the accounting information may comprise collected meter data which is assimilated or complied and/or modified by the accounting unit 416. For example, in one embodiment, individual meter pulse data may be provided to the accounting host 426. In another embodiment, the accounting unit 416 might provide data regarding meter pulses over a period of time, or even more complex data such as calculated "value" data (determined from pulse representing "credits" and the denomination of each "pulse"). Of course, it will be appreciated that the data may have various forms. Preferably the data is encoded, such as with a machine code, so that the source of the data may be confirmed at the accounting host 426. The data may also be encoded to protect or secure it, such as by encryption.

The accounting host 426 preferably stores transmitted accounting data. For example, transmitted data may be stored in one or more files of a memory of the accounting host 426.

In one embodiment, the accounting host 426 includes a processor capable of running one or more applications. One such application may be an accounting program capable of reading the accounting data and manipulating that data or displaying the data. The accounting host 426 may also include one or more output devices, such as displays or printers. For example, the accounting program may permit a user to cause the accounting host 426 to display accounting data for a particular gaming machine during a particular period of time. Such applications are well known.

As indicated, in one embodiment the gaming machine 402 may be configured to transmit accounting information to the accounting host 426. In one embodiment, such a transmission may be performed at particular time intervals, upon occurrence of particular events, and/or in response to instructions received from the accounting host 426. In this regard, various techniques may be employed to manage the flow of data traffic, such as to prevent overloading of the communication link or links.

In accordance with this aspect of the invention, an accounting system for one or more gaming machine permits collection and use of gaming machine accounting data. Using the accounting system of the invention, monetary activities at the gaming machine may be tracked and audited. For example, an operator of the gaming machine may determine, from a remote location, the amounts paid in and paid out at the gaming machine over a period of time. The accounting data may be used for various purposes, including to prevent fraud or theft, for tracking revenues, game performance and a variety of other purposes.

As illustrated in FIG. 6, the accounting system 400 may include a plurality of gaming machines 402 associated with a common accounting host 426. The gaming machines 402 and accounting host 426 may communicate, at least partially, over one or more common communication links.

In accordance with another embodiment of the invention, a coin or cash-less system is provided for one or more gaming machines. In a preferred embodiment, this system is a "ticket" system which permits a player to be paid or "cash-out" by being provided a printed ticket or slip, and which permits a player to submit a value slip or ticket to a gaming machine to provide value for game play/wagers. For this reason, the system may be referred to as a ticket system One embodiment of a gaming machine configured to issue and accept value slips or tickets, and a system of a plurality of such machines, will be described with reference to FIGS. 5 and 6. As illustrated in FIG. 5 and described above, a gaming machine 402 preferably includes a primary metering system and a secondary metering system, as well as an accounting unit.

In this embodiment, the reader 414 is configured to read printed tickets or slips. The reader 414 may be configured in various fashions depending on the information to be read from the ticket. For example, the reader 414 may be a barcode reader for reading information from the ticket.

In addition, the gaming machine 402 includes a printer 428. The printer 428 is configured to generate, such as by printing, one or more tickets. In one embodiment, the printer 428 is configured top print individual media, such as paper sheets. The media may also comprise a roll of paper which is divided, such as by tearing or with a cutter, into individual tickets or slips.

Figure 9:
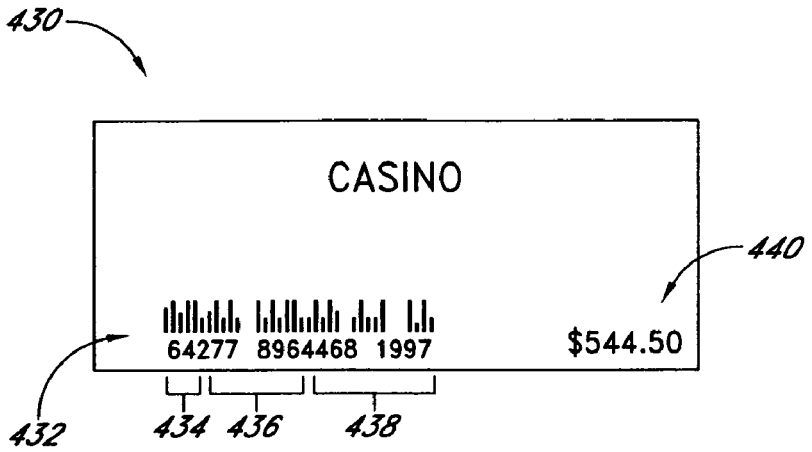
FIG. 9 illustrates one embodiment of a ticket.

One embodiment of a ticket 430 is illustrated in FIG. 9. As illustrated, the ticket 430 preferably bears indicia. In one embodiment, the indicia include one or more machine readable codes 432, such as a bar code. Preferably, the code 432 represents information, such as numbers and/or letters. For example, in one embodiment the code 432 may represent a machine identification number 434, a ticket number 436 and an issue date and time 438. The generation and use of this information will be described below.

In one embodiment the ticket 430 may also include various human-readable information such as the ticket value 440. Advertising, the name of the casino or other property at which the ticket was issued, redemption instructions and other information may also be located on the ticket.

Preferably, the system is configured to implement the various methods detailed below. In general, the accounting unit 416 is configured to generate accounting information from the meter information which is gathered. This accounting information is used to determine the total value of monies belonging to a player of the gaming machine at any given time. When the player wishes to "cash-out," the accounting unit 416 is configured to generate ticket information and cause the ticket printer 428 to print a ticket 430.

The reader 414 is configured to read a ticket 430 which is presented by a player. The reader 414 transmits ticket information to the accounting unit 416 for verification. If the ticket is verified, the ticket reader 414 is instructed to "credit" the value of the ticket to the gaming machine, such as in the manners described in more detail below.

Figure 8A:
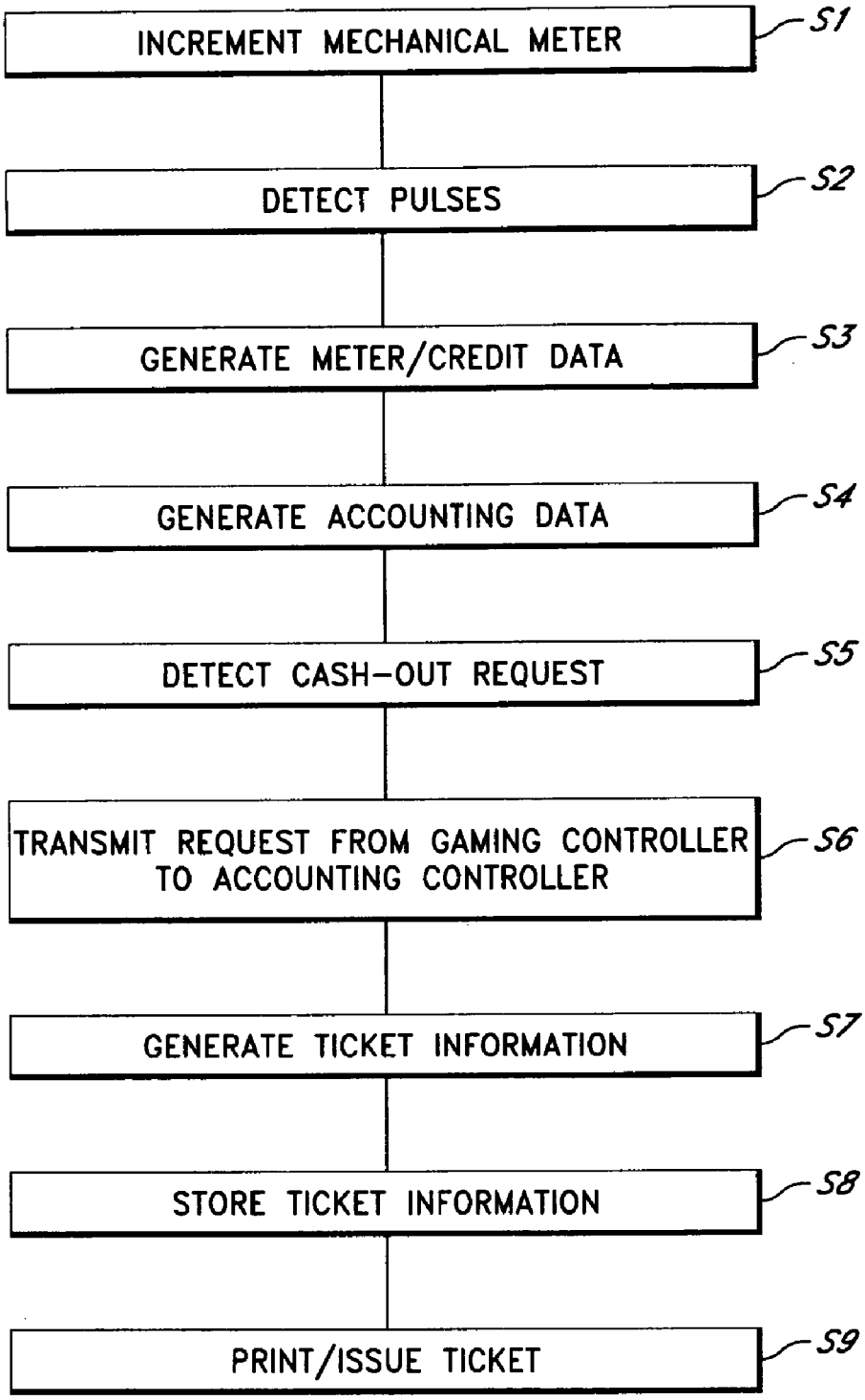
FIG. 8A is a flow diagram of a method of generating a ticket at a gaming machine in accordance with an embodiment of the invention.

One embodiment of a method of the invention will be described with reference to FIG. 8A. In a step S1, one or more of the mechanical meters 404 of the gaming machine 402 are incremented. As detailed above, this step may be accomplished by the gaming controller 406 sending a signal via an interface 410 to the meter 404. The gaming controller 406 may generate such a signal in response to a "value" event at the gaming machine, such as the receipt of coins, cash, or as described in more detail below, a ticket, or a game win, game loss, or payout.

In a step S2, the incrementing of the counter of the mechanical meter 404 is detected by the detector 412 of the system of the invention. This aspect of the invention is described in more detail above.

In a step S3, meter data is generated. This step may include the generation of a pulse by the detector 412 of the secondary metering system, as well as the generation of a data element representing that pulse by the accounting controller 422. As described above, information regarding mechanical meter events may be tracked in various ways.

In a step S4, accounting data is generated. Preferably, this accounting data includes the value of monies belonging to the player of the machine. For example, the accounting controller 422 may utilize information collected from the various mechanical meters 404 of the machine to generate a collective value of the sum of credits or monies belonging to the player. If a player inputs $100.00 in coins to the gaming machine 402, wagers $50.00, and receives winnings of $75.00, then these values, as reflected by individual meter events, enables the accounting controller to determine that the player has $125.00 in credits or value at the machine. In this regard, it is preferred that the system of the invention include detectors regarding as many or all of the mechanical meters as is necessary to accurate track and determine the monetary transactions occurring at the machine.

It will be appreciated that each increment of the mechanical meter is simply a number increment, such as one (1), and does not represent value per se. The "value" associated with each numerical increment is determined by the "denomination" of the value event. As is known in the art, gaming machines are configured to represent the value provided to them by a player as credits of a particular denomination. For example, if the machine is configured to accept wagers of $0.25 denominations and a player provides a $20.00 bill, the player will be credited with 80 credits. In that event, the gaming controller 406 is preferably configured to increment the "credit in" meter by 80. In some events, the denomination of wager may be changed at a machine, such as by a player between games. In that event, the number of credits will be modified to reflect the change in denomination. For example, if a player has 80 credits of $0.25 denomination, the player would only have 20 credits of $1.00 denomination.

Preferably, the gaming controller 406 is configured to communicate the denomination of credits in, credits won and the like, to the accounting controller 422. In this manner, the accounting controller 422 can convert the numerical meter data to the actual monetary value.

In accordance with the invention, if a player has credits at a gaming machine and wishes to stop playing that machine, the player is permitted to obtain a ticket for the monetary value of those credits. Of course, the player might be permitted to instead be paid in other manners, such as coins.

In a step S5, if a cash-out signal is received, such as by a player's input to a cash-out button or touch-screen location, then the gaming controller 406 is preferably configured to transmit that request to the accounting controller 422, by a signal, as in step S6. In a step S7, the accounting controller 422 is preferably then configured to generate ticket information.

In one embodiment, the ticket information includes the code 432 and other information which is to be printed or associated with the ticket 430, as well as information regarding the ticket which is to be stored, such as information for verifying the ticket at a later time. In one embodiment, the accounting controller 422 generates the code 432. Preferably, the code 432 includes a unique ticket identifier, such as a ticket code. In an embodiment where a plurality of machines are configured to generate and dispense tickets and those tickets may be presented at other machines, the ticket code preferably includes a machine code. The machine code identifies the gaming machine at which the ticket was generated, and is preferably unique to each particular machine of the system. In one embodiment, the accounting controller at each gaming machine generates a code including the machine identifier and a unique ticket number, the ticket number preferably at least being unique to the particular machine. In this manner, all tickets issued at all of the gaming machines of the system have a different ticket identifier.

As indicated, the ticket information or code may include a variety of other or additional information, such as the time and day the ticket was issued. Where a player tracking system is being used, the ticket code may also include player identification information used to identify the player via the player tracking system.

The accounting controller 422 preferably saves information regarding the ticket, such as at its associated memory 424, as in a step S8. For example, the accounting controller 422 may create a ticket record including the ticket identifier, time of ticket generation, ticket value and associated information. Associated information may include a field or flag indicating whether the ticket has been redeemed or presented.

The accounting controller 422 send ticket information to the ticket printer 428, causing the ticket printer to print the ticket, in a step S9. Once dispensed, the player may collect the ticket.

In a preferred embodiment of the invention, the player may redeem the ticket for value, such as at a cash-out station. Referring to FIG. 6, in one embodiment of the system, the gaming machines 402 are connected to one another and to one or more cash-out stations 450 via one or more communication links.

The cash-out station 450 may be a wholly or partially automated station. When configured as a partially automated station, the cash-out station may be associated with a cashier. In such an instance, a player may present their ticket to the cashier. The cashier may then insert the ticket to a reader or otherwise scan or input the ticket information from the ticket 430. The ticket is then verified in manner similar to that described below. Once verified, the cashier may pay the player monies in the value of the ticket.

In the case of an automated station 450, the player may directly present the ticket, such as by inserting it into a reader. Once verified, the cash-out station may be configured to dispense coins, currency or other elements in a value of value represented by ticket.

In a preferred embodiment, the player may also present the ticket 430 to the gaming machine at which the ticket was issued or any other gaming machine of the system. Preferably, when the ticket is presented to a gaming machine, the value of the ticket is credited to the machine for use by the player in placing wagers.

Figure 8B:
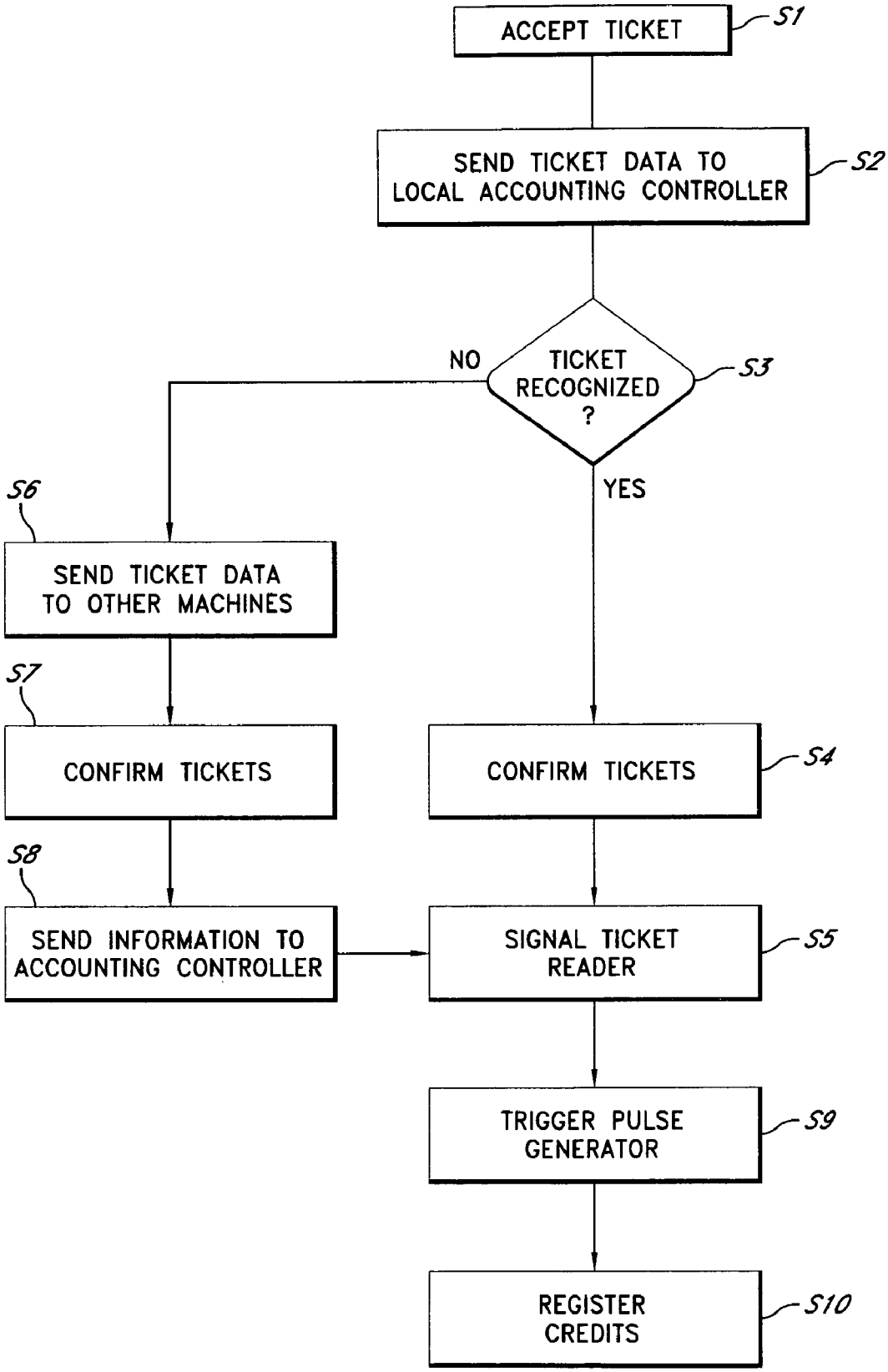
FIG. 8B is a flow diagram of a method of accepting a ticket at a gaming machine in accordance with an embodiment of the invention.

One embodiment of a method of accepting a ticket will be described with reference to FIG. 8B. In a step S1, the ticket is accepted at the gaming machine 402. In a preferred embodiment, a player inserts the ticket in to the reader 414 associated with the gaming machine 402.

In a step S2, information is obtained from the ticket and is transmitted from the reader 414 to the accounting controller 422. In a preferred embodiment, the reader 414 reads the machine readable information associated with the ticket 430, such as by scanning the bar code 432 on the machine.

In a step S3 it is determined if the ticket 430 is recognized by the accounting controller 422 of the machine at which the ticket is presented. This step may include the step of comparing the ticket identifier to those ticket identifiers stored in the memory 434 associated with the accounting controller 422. In the preferred embodiment of the system where each machine generates its "own" tickets and stores information only regarding information regarding those tickets, the unless a ticket presented at the gaming machine was also issued by that machine, then the ticket will not be recognized.

Figure 10:
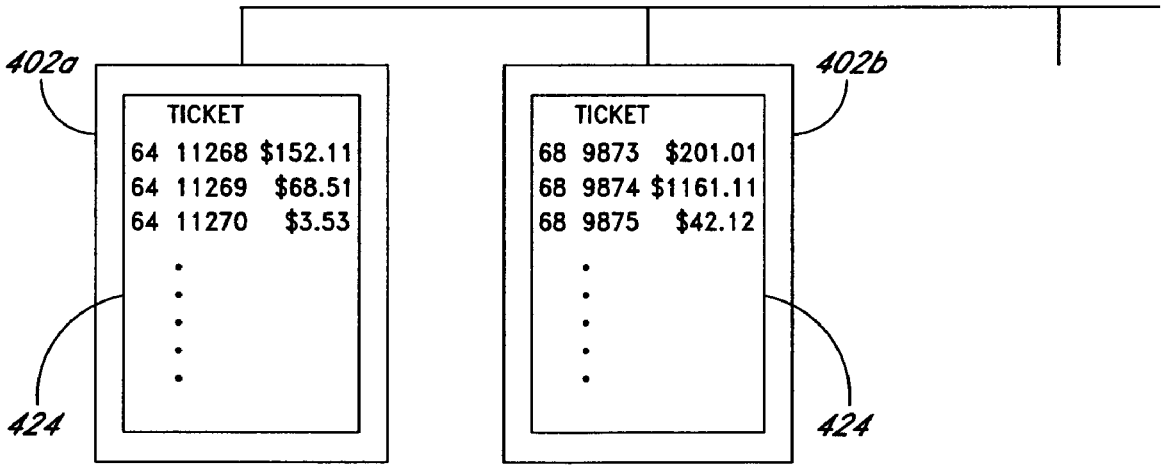
FIG. 10 illustrates a ticket information storage configuration of a system of the invention.

If the ticket is recognized by the accounting controller 422, then in a step S4, the ticket is verified or confirmed. As indicated above, in a preferred embodiment, information regarding the ticket issued at each machine preferably stored at that machine. Referring to FIG. 10, if a ticket having ticket identifier is 6411268 is presented at gaming machine 402*a*, it the accounting controller 402 can verify that this ticket was issued at this particular machine, can check to determine if the ticket is valid and, if so, the value of the ticket (in this case $153.11).

In one embodiment, verification of the ticket includes a determination of whether the ticket was previously presented and/or redeemed. As indicated, a data entry associated with the ticket may be utilized to indicate whether the ticket was already redeemed. If this entry or flag is indicated, then the ticket is preferably rejected, preventing it from being paid or redeemed a second time. In such event, a signal may be sent from the accounting controller 422 to the ticket reader 414 to either reject the ticket (and eject it to the player) or to keep the ticket (such as by drawing it into a secure box) but not credit the ticket. The player may be provided an indicator of the status of the ticket as accepted or rejected, such as a visible displayed instruction.

In the event the ticket is verified, the value of the ticket is confirmed. Preferably, this comprises determining the value from the data stored with the ticket information at the accounting unit 416. For example, ticket identifier 6411268 may be determined to have a value of $153.11 from the stored ticket information at the machine.

If the ticket is verified or confirmed, then in a step S5, a signal is transmitted to the ticket reader 414 regarding the value of the ticket to be credited.

In step S3, if the ticket is not recognized at the machine where the ticket was presented, then in a step S6, the accounting controller 422 preferably sends a signal to the other machines associated with the system regarding the ticket number requesting verification thereof. Preferably, this signal is transmitted to the accounting controller 422 of each machine 402, and the accounting controllers of the other machines then determined if they recognize the ticket. In one embodiment, the signal may be transmitted to all machines at the same time, for parallel processing. In another embodiment, the signal may be transmitted serially from one machine to the next until a machine recognizes the ticket. In yet another embodiment, the accounting controller 422 may be configured to recognize the machine identifier of the ticket code and then transmit the ticket identifier directly to that machine.

Once the ticket identifier is recognized by a particular gaming machine, then the ticket is verified or confirmed in a step S7, similar to the step S4 described above. For example, referring to FIG. 10, if a ticket having ticket identifier 689873 is presented at gaming machine 402*a*, the accounting controller of that machine can confirm that the ticket was not issued at that machine. The accounting controller then sends a signal to the other machine(s). In this case, the accounting controller of gaming machine 402*b* will recognize the ticket identifier.

The accounting controller at which the ticket is verified (e.g. gaming machine 402*b* of FIG. 10 in the just-described example) then transmits verification information, preferably comprising at least the value of the ticket (such as the value $201.01, referring to the example of FIG. 10), to the accounting controller from which the request originated, in a step S8. The originating accounting controller 422 then transmits the ticket value information to the reader 414, as in step S5 described above.

In an embodiment gaming machine such as that illustrated in FIG. 5 where the machine 402 includes a pulse generator 415, once the reader 414 is provided the value of the ticket 430, the reader 414 signals the pulse generator to send an appropriate number of pulses to the gaming controller 406 representative of the ticket value, as in step S9. The operation of a pulse generator 415 in a gaming machine is well known. In general, such pulse generators are configured to send a pulse representative of each "credit" worth of value provided to the gaming machine. For example, if the gaming machine is operating on a denomination of $0.25 and a player inserts $1.00 in quarters to the coin acceptor 412, the pulse generator is configured to generate four (4) pulses, thus providing the gaming controller 406 with instructions to credit four (4) $0.25 denomination credits. Similarly, in this embodiment, if the reader 414 is instructed that the ticket value is $100 and the gaming machine denomination is set at $0.25, then the pulse generator will be caused to generate 400 pulses.

In a step S10, the credits representing the ticket value are credited or registered. In one embodiment, this includes the step of the gaming controller 406 recognizing the credits and confirming, such as by visible display, the number of credits available to the player for play. In a preferred embodiment, the credits are also registered at one of the mechanical meters 404. Likewise, the accounting controller 422 can confirm that the credits were recognized by detecting the meter incrementing.

As described above, many gaming machines utilize analog communications and utilize a pulse generator to communicate "credit-in" to the gaming controller. In newer machines, digital communications are utilized. In such event, digital data is utilized to provide value information. FIG. 7 illustrates such an embodiment gaming machine 402*a*. In that embodiment, the reader 414*a* is preferably configured to generate an output which is provided to a signal generator 415*a*. The signal generator 415*a* provides a digital data signal to the gaming controller 406*a* regarding "credit in" value.

In such an embodiment, step S9 of the method described above is modified so that the signal generator 415*a* is caused to signal the gaming controller 406*a* so that the gaming controller 406*a* registers the credits representing the value of the ticket.

As described above, in one embodiment, a player may be permitted to cash-out or redeem a ticket at a cash-out station. A method of redeeming a ticket 430 at a cash-out station is similar to the method described above and illustrated in FIG. 8B. When the player (directly or via a cashier or otherwise) presents the ticket, a controller at the station 450 transmits the read ticket identifier to the gaming machines 402 in order to verify the ticket. Once verified, ticket value information is transmitted back to the station 450, causing the station 450 to issue monies to the player or causing the cashier to pay the player.

Of course, once a ticket is redeemed and paid, the machine which stores the ticket data for that ticket preferably stores information to the effect that the ticket has been redeemed to prevent its redemption in the future.

A variety of alternate configurations of the method and apparatus of the invention are contemplated as within the scope of the invention, and the invention may include additional features or elements. It will be appreciated that the term "accounting controller" is used for convenience and reference only, and the elements or devices which are used to accomplish the methods of the invention may be referred to by other names.

In one embodiment of the invention, when a ticket is transmitted at a gaming machine, ticket information regarding the ticket may be transmitted to all gaming machines. In this manner, each gaming machine may include a complete, duplicate record of all tickets generated by all machines. When ticket information is accessed or modified, such updates are then preferably transmitted to all of the gaming machines, thus ensuring that all gaming machines include the same ticket information. This embodiment system has the advantage that if a gaming machine goes off-line and a ticket which that off-line machine issued is presented at another machine, the ticket can still be verified.

The methods, apparatus and systems of the invention have numerous advantages and features. Numerous advantages of the metering system are described above. A particular advantage of the accounting system is the ability for the gaming operator to track and audit all monetary transactions occurring at every gaming machine. In the preferred embodiment of the invention, this tracking and auditing can be accomplished in real time, and from a remote location. A gaming machine operator can thus ensure that monies provided to and paid out by the gaming machine are accurate to reduce fraud (such as potential theft of coins from the coin hopper, use of fraudulent tickets and the like) and to track gaming machine activities, including revenues and profits.

In accordance with the ticket system of the invention, the ability to audit the gaming machine monetary transactions can be used to ensure that tickets are being properly generated and redeemed across the entire system. For example, if a player creates and attempts to use a fraudulent ticket, credit for the ticket will not match monies shown as "paid" by the gaming machines, since no such ticket was created.

The system of the invention also permits players to "cash-out" and be paid in the form of a ticket instead of coins, currency or the like. Similarly, this system allows a player to utilize a ticket to provide value to a machine, rather than providing coins, currency or other forms of payment.

The particular "ticket" system of the invention has numerous benefits. A first aspect of the system is that it is "distributed." Unlike the prior art, each gaming machine is responsible for generating and issuing its own tickets, and for confirming tickets it issues. This eliminates the need for a complex host or server configuration and associated data traffic. Further, in the preferred embodiment, this configuration allows the existing accounting unit associated with the secondary metering system to perform these functions, thus not requiring significant additional hardware. In essence, once the metering and accounting systems exist, the ticket system "support" already exists within the structure. This configuration thus avoids the need for additional complex servers and hosts to service all of the gaming machines ticketing functions.

While the description above refers to particular embodiments of the present invention, it will be understood that many modifications may be made without departing from the spirit thereof. The accompanying claims are intended to cover such modifications as would fall within the true scope and spirit of the present invention.

I claim:

1. A method of accepting a value ticket having an associated value at a gaming machine of a system including a plurality of gaming machines at which tickets are dispensed comprising:

accepting a ticket at a reader of a first gaming machine;

reading information from said ticket;

transmitting ticket information from said reader to an accounting controller of said first gaming machine;

determining if said ticket was generated at said first gaming machine and, if so, determining if said ticket is valid and, if so, determining a value of said ticket and sending a signal to said reader regarding said value;

if said ticket was not generated at said first gaming machine, sending ticket information to at least the gaming machine at which said ticket was generated, determining if said ticket is valid and, if so, determining a value of said ticket and sending a signal to said reader regarding said value; and transmitting at least one signal from said reader to cause a gaming controller of said first gaming machine to credit said value of said ticket.

2. The method in accordance with claim 1 wherein said step of transmitting at least one signal from said reader comprises transmitting a signal to a pulse generator regarding a number of credit pulses to generate representative of said ticket value.

3. The method in accordance with claim 1 wherein said step of sending ticket information comprises transmitting ticket information from said first gaming machine to each of said plurality of gaming machines.

4. The method in accordance with claim 3 further comprising the step of comparing said ticket information at each of said plurality of gaming machines to ticket records stored at each of said plurality of gaming machines, where said ticket records stored at each of said plurality of gaming machines comprise information regarding a ticket generated at that gaming machine.

5. The method in accordance with claim 4 further comprising matching said ticket information to one of said ticket records at one of said plurality of gaming machine and wherein said step of sending a signal to said reader comprises sending information regarding a value of said ticket from said gaming machine at which said ticket was matched to said reader of said first gaming machine.

6. The method in accordance with claim 1 wherein said first gaming machine stores one or more ticket records regarding tickets generated at said first gaming machine and said step of determining if said ticket was generated at said first gaming machine comprises comparing said ticket information to said ticket records at said first gaming machine.

7. The method in accordance with claim 1 wherein said first gaming machine is configured to present a slot or video poker game.

8. The method in accordance with claim 1 wherein said ticket information comprises at least a unique ticket code which identifies said ticket.

* * * * *